US011022396B2

(12) United States Patent
Brewer et al.

(10) Patent No.: US 11,022,396 B2
(45) Date of Patent: Jun. 1, 2021

(54) RIFLE BARREL VIBRATION DAMPENER AND METHOD OF USE

(71) Applicants: Ken Brewer, Spokane, WA (US); Michael Ryan, Henderson, NV (US)

(72) Inventors: Ken Brewer, Spokane, WA (US); Michael Ryan, Henderson, NV (US)

(73) Assignee: Superior Harmonics LLC, Henderson, NV (US)

( * ) Notice: Subject to any disclaimer, the term of this patent is extended or adjusted under 35 U.S.C. 154(b) by 0 days.

(21) Appl. No.: 16/804,505

(22) Filed: Feb. 28, 2020

(65) Prior Publication Data

US 2021/0048265 A1 Feb. 18, 2021

Related U.S. Application Data

(60) Provisional application No. 62/888,538, filed on Aug. 18, 2019.

(51) Int. Cl.
*F41A 21/44* (2006.01)

(52) U.S. Cl.
CPC ..... *F41A 21/44* (2013.01)

(58) Field of Classification Search
CPC ..... F42A 21/44
USPC ..... 42/76.01
See application file for complete search history.

(56) References Cited

U.S. PATENT DOCUMENTS

| | | | | | |
|---|---|---|---|---|---|
| 4,346,643 | A * | 8/1982 | Taylor | F41A 21/44 | 89/14.1 |
| 4,424,734 | A * | 1/1984 | Janssen | F41A 21/44 | 89/16 |
| 4,638,713 | A * | 1/1987 | Milne | F41A 21/44 | 89/14.1 |
| 4,753,154 | A * | 6/1988 | Higashi | F41A 21/44 | 165/104.26 |
| 4,841,836 | A * | 6/1989 | Bundy | F41A 21/44 | 89/14.1 |
| 5,657,568 | A * | 8/1997 | Christensen | F41A 21/02 | 42/76.01 |
| 5,856,631 | A * | 1/1999 | Julien | F41A 21/02 | 42/76.02 |
| 6,615,702 | B1 * | 9/2003 | Julien | F41A 21/02 | 42/76.02 |
| 6,889,464 | B2 * | 5/2005 | Degerness | F41A 21/02 | 42/76.01 |
| D584,375 | S * | 1/2009 | Sims | D22/107 | |
| D692,976 | S * | 11/2013 | Sims | D22/107 | |
| 8,869,443 | B2 * | 10/2014 | Fonte | F41A 21/02 | 42/76.01 |
| 9,217,619 | B2 * | 12/2015 | Fonte | F41A 21/02 | |
| 9,239,202 | B2 * | 1/2016 | Michal | F41A 21/24 | |
| D767,072 | S * | 9/2016 | Dulisse | D22/108 | |
| D767,073 | S * | 9/2016 | Dulisse | D22/108 | |
| D778,386 | S * | 2/2017 | Farthing | D22/108 | |
| D778,387 | S * | 2/2017 | Farthing | D22/108 | |

(Continued)

*Primary Examiner* — Joshua E Freeman
(74) *Attorney, Agent, or Firm* — Bretton L. Crockett; TechLaw Ventures, PLLC

(57) ABSTRACT

The disclosure of the present invention relates to a rifle barrel vibration dampener or to a vibration dampener sleeve configured to be fit over a portion of a rifle barrel in order to control the harmonic frequency vibration amplitude within the barrel, improving shot group accuracy; while additionally, improving the appearance of the rifle and protecting the outside surface of the rifle barrel.

4 Claims, 6 Drawing Sheets

(56) References Cited

U.S. PATENT DOCUMENTS

| | | | | |
|---|---|---|---|---|
| D779,618 | S * | 2/2017 | Farthing | D22/108 |
| 10,302,384 | B1 * | 5/2019 | Lee | F41A 21/325 |
| 10,365,061 | B1 * | 7/2019 | Painter | F41A 21/44 |
| 2011/0100204 | A1 * | 5/2011 | Schlenkert | F41A 21/44 89/14.1 |
| 2011/0107647 | A1 * | 5/2011 | Johnson | F41A 23/16 42/97 |
| 2012/0227302 | A1 * | 9/2012 | Fonte | C22C 19/05 42/78 |
| 2013/0061503 | A1 * | 3/2013 | W. | F41A 21/44 42/76.01 |
| 2015/0241159 | A1 * | 8/2015 | Michal | F41A 21/30 89/14.4 |
| 2016/0084603 | A1 * | 3/2016 | Michal | F41A 35/00 42/94 |
| 2016/0363402 | A1 * | 12/2016 | Mogle | F41A 21/02 |
| 2017/0115085 | A1 * | 4/2017 | Johnson | F41A 21/36 |
| 2017/0261280 | A1 * | 9/2017 | Glisovic | F41A 21/24 |
| 2017/0276449 | A1 * | 9/2017 | Newcomb | F41A 23/02 |
| 2018/0017350 | A1 * | 1/2018 | Kowalski | B32B 9/041 |
| 2019/0310044 | A1 * | 10/2019 | Glisovic | F41A 21/20 |
| 2020/0348099 | A1 * | 11/2020 | Hart | F41A 13/12 |

* cited by examiner

RIFLE BARREL VIBRATION DAMPENER AND METHOD OF USE

The present application relates to, and claims priority from, provisional application U.S. 62/888,538, filed Aug. 18, 2019. The disclosure therein, incorporated by reference.

SUMMARY OF THE INVENTION

The disclosure of the present invention relates to rifle barrel vibration dampeners and more specifically to a vibration dampener configured to be fitted onto a rifle barrel to reduce barrel harmonic vibration and to improve overall accuracy.

As commonly known in the art, each rifle barrel is unique, having different performance characteristics including variation due to the barrels harmonic frequency, or the unique vibration waveform created in the barrel when the gun is fired with a specific round of ammunition. The harmonic frequency can be affected or altered by changing the mass, or the grains, of the bullet, by the type and amount of propellant used which changes muzzle exit velocity, or myriad combinations of the two. Precision shooters or hunters who demand extreme accuracy normally choose hand loaded ammunition where steps such as, case preparation, primer choice, propellant type, propellant volume, bullet shape, bullet grains and depth of the bullet seat are all carefully controlled to insure top performance and accuracy. However, even with stringent loading controls, a slight variation in ammunition performance will cause the harmonic frequency of a barrel to move a shot away from an acceptable bullet grouping.

Rifle manufacturers and custom rifle builders have used numerous methods to control the amplitude of barrel harmonic frequency in order to produce consistent shot groupings, including producing over-sized "bull" barrels, fluted barrels and barrels having windings comprised of composite fibers, such as fiberglass, graphite and Kevlar. However, these solutions can add significant weight to the rifle and/or tend to be expensive aftermarket options.

What is needed is an inexpensive, lightweight solution to control the amplitude of the harmonic frequency of a rifle barrel and improve shot accuracy.

A first embodiment of the present invention is a simple, high durometer and high tensile strength, sleeve configured to be securely fitted on the barrel of rifle and reduce the harmonic frequency of the barrel. The sleeve can be configured to fit over the barrel between the muzzle and the rifle forestock; covering only a portion of the barrel or the portion of the barrel with the highest propensity for vibration or movement. The sleeve can be configured to cover approximately one-quarter to one-half of the overall barrel length, with a preferred embodiment where the sleeve covers approximately one-third of the overall barrel length. The sleeve can be formed using a poly olefin, such as, but not limited to, polyethylene or polypropylene. The sleeve may be thermoplastic in one embodiment, and may have an inside diameter slightly smaller than the outside diameter of the rifle barrel. The sleeve can be carefully heated to a normalized temperature where the sleeve expands to fit over the rifle barrel and then heated to a fitting temperature where the sleeve contracts securely around the outside diameter of the barrel.

In a second embodiment the sleeve is formed using a thermoplastic sleeve having a diameter slightly larger than the outside diameter of the rifle barrel. After the sleeve is placed over the muzzle and into position on the barrel, the sleeve can be carefully heated in an oven or heated using a heat gun to shrink the sleeve evenly and securely around the barrel.

In yet another embodiment the sleeve can be configured using an elastomeric material such as neoprene or silicone rubber and having a diameter, again slightly smaller than the outside diameter of the barrel. The sleeve is stretched in order to be fitted over the barrel. In one embodiment the sleeve can be lubricated using a "non-reactive" lubricant such as liquid silicone in order to aide ease of installation and to prevent oxidization or corrosion of the barrel under the sleeve. It is contemplated that pressurized air may be used when installing an elastomeric sleeve.

In another embodiment of the present invention, the vibration dampener sleeve is configured to cover the full length of the rifle barrel from the muzzle to the end of the chamber. In this embodiment it is necessary for the rifle to be disassembled prior to fitting the vibration dampener sleeve onto the barrel. Once the dampener sleeve has been fitted onto the barrel, the rifle can be re-assembled and the barrel and stock clearance can be adjusted.

In yet other embodiment an internal insulating material may be used in order to again improve shot performance and to reduce perceived vibrations felt by the user. In one embodiment, the interior of the sleeve can be coated with a uniform film of insulating material such as elastomeric silicone. The silicone layer will remain between the sleeve and the rifle barrel after installation and will further reduce the amplitude of the harmonic frequency of the barrel. The silicone layer will seal any space between the barrel and the sleeve and may also include corrosion inhibitors to preserve the barrel finish under the sleeve.

In another embodiment a silicone sublayer can be applied as internal ribs or ribbons to the interior the vibration damping sleeve. It is contemplated that a free space is left between each internal rib to allow for uniform coverage of the barrel after the thermoplastic sleeve has been shrunk and fitted.

It is recognized that the wall thickness of the vibration dampener is greater than an esthetic film and has enough tensile strength and rigidity to control the harmonic frequency amplitude of the rifle barrel. The wall thickness of the vibration dampener sleeve is less than 1/10 of dimension for the outside diameter of the sleeve.

The outside surface of the vibration dampening sleeve can include ornamentation to reduce barrel glare, to provide camouflage or a faux finish to simulate a pattern on the stock, to simulate a composite, simulate metal or any other desired finish which can be applied to a plastic surface.

BRIEF DESCRIPTION OF DRAWINGS

The following description of the embodiments can be understood in light of the Figures, which illustrate specific aspects of the embodiments and are part of the specification. Together with the following description, the Figures demonstrate and explain the principles of the embodiments.

DETAILED DESCRIPTION OF THE DRAWINGS

Figure 1:
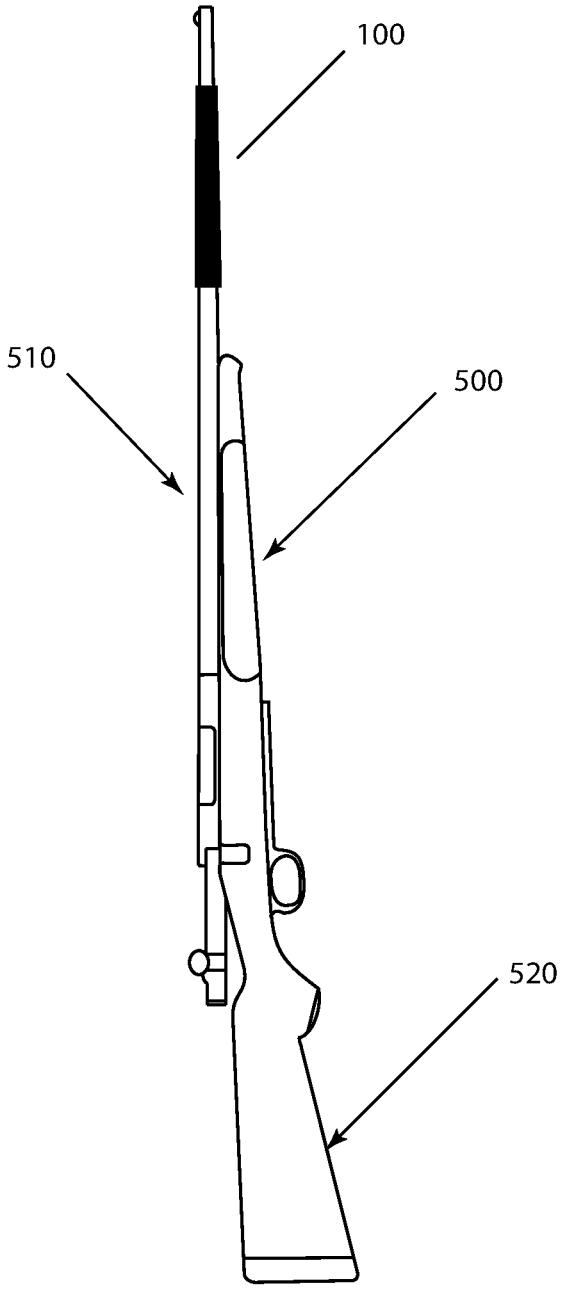
FIG. 1 a side view of a rifle including the vibration dampener of the present invention, FIG. 2 an assembly view of a vibration dampener, FIGS. 3A and 3B detail view of a vibration dampener, FIGS. 4A and 4B perspective views of embodiments of a vibration dampener, FIG. 5A an end view of a vibration having an interior insulating film, FIG. 5B an end view of a vibration dampener including interior insulating ribs, and, FIGS. 6A and 6B are example targets showing the benefit of the present invention.

The following description of the embodiments can be understood in light of the Figures which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals or word descriptions in different drawings represent the same element, and thus their descriptions may be omitted.

A first embodiment of the present invention or rifle barrel vibration dampener 100 is shown installed on a rifle 500 having a barrel portion 510 and stock 520.

Figure 2:
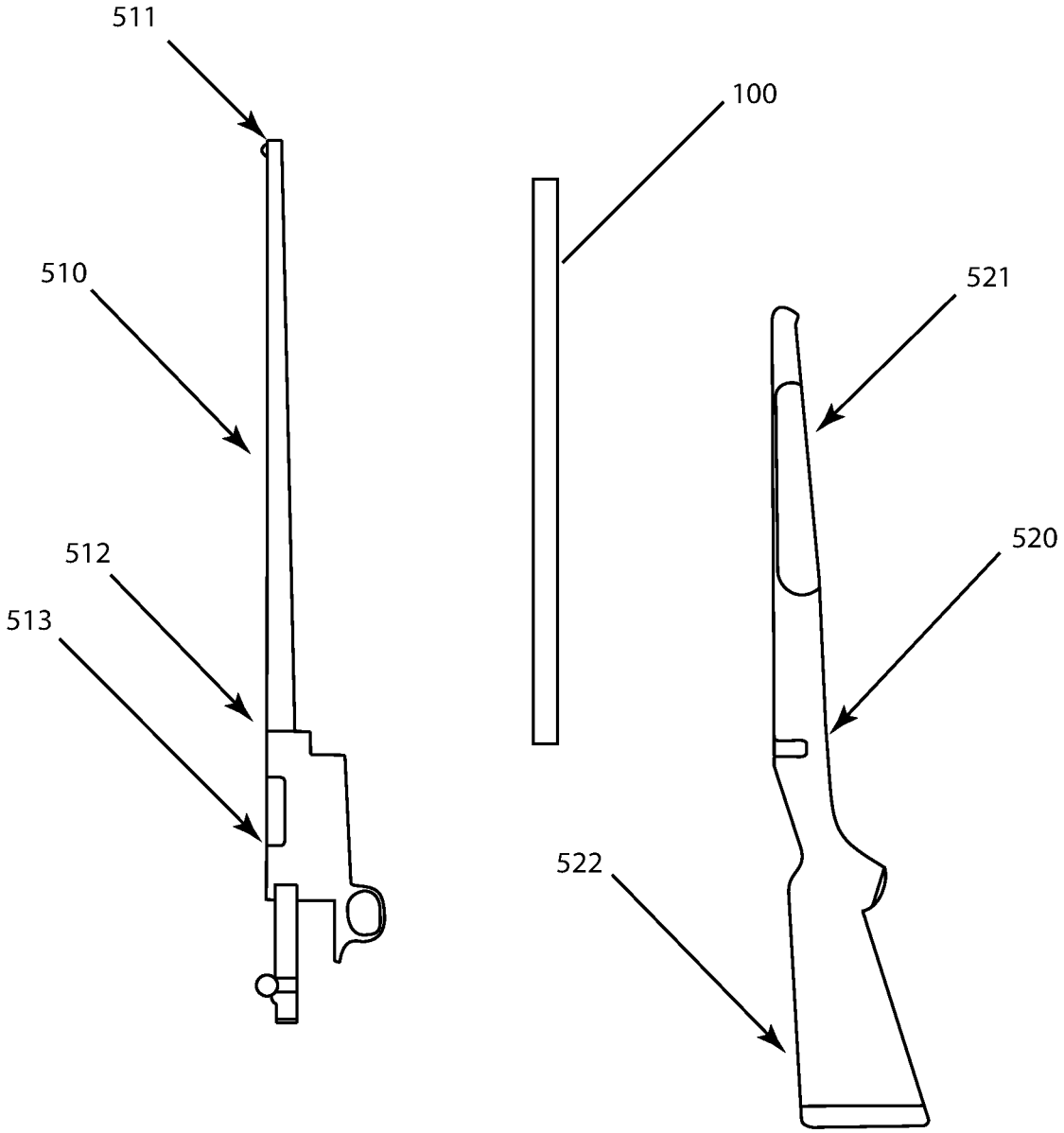

Illustrated in FIG. 2 includes a vibration dampener 100 configured to extend the full length of the rifle barrel 510, extending from the muzzle 511 to the end of the chamber 512. This configuration provides harmonic frequency dampening control over the entire length of the barrel 510, however, it is recognized that installation of the full length dampener 100 requires disassembly of the rifle 500 separating the barrel 510 from the stock 520. The stock 520 includes a forestock 521 and buttstock 522. The barrel 510 is attached the action 513. The action 513, may be a bolt action as shown, lever action, pump action, break action, rolling block, semi-automatic or automatic.

Figure 3A:
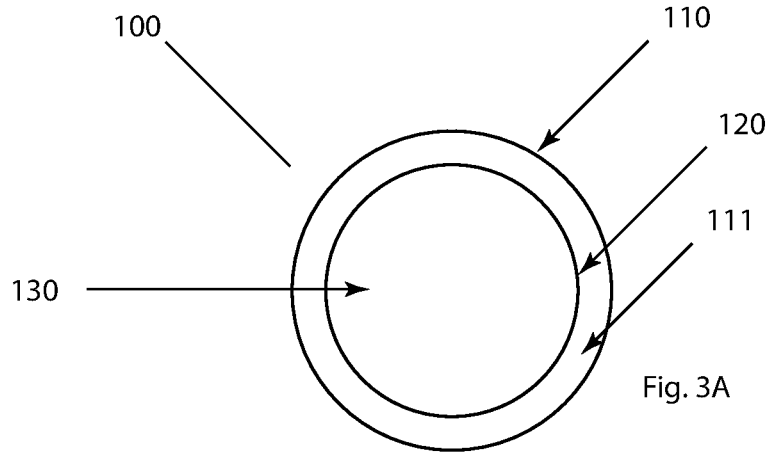
Figure 3B:
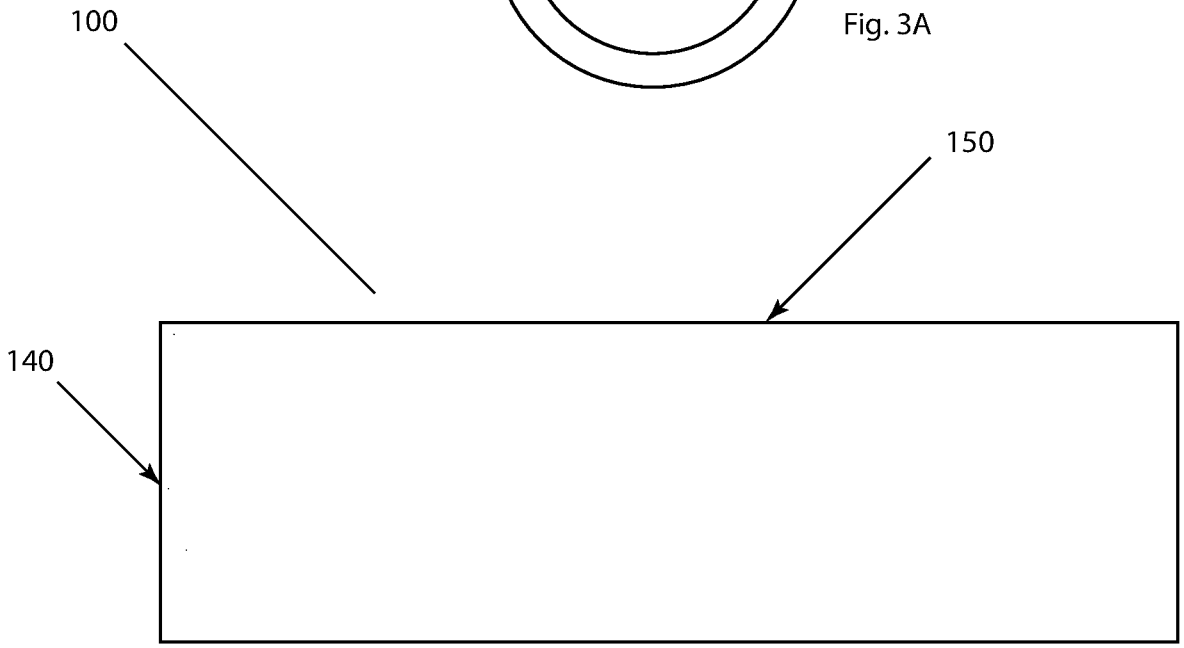

FIGS. 3A and 3B are one embodiment of the present invention or rifle barrel vibration damper, or vibration dampening sleeve 100. The sleeve 100 including an outside diameter 110, inside diameter 120, inside opening or void 130, end portion 140 and side portion 150. The inside diameter 110 is configured to securely fit over the outside diameter of a rifle barrel 510 and the length of the side portion 150 will reflect the desired amount of the barrel 510 which is covered by the sleeve 100. It is contemplated that sleeve 100 will cover at least ¼ of the rifle barrel 510 and up to the full length of the rifle barrel 510. Sleeve wall thickness 111 is less than 1/10 of the outside diameter 120.

Figure 4A:
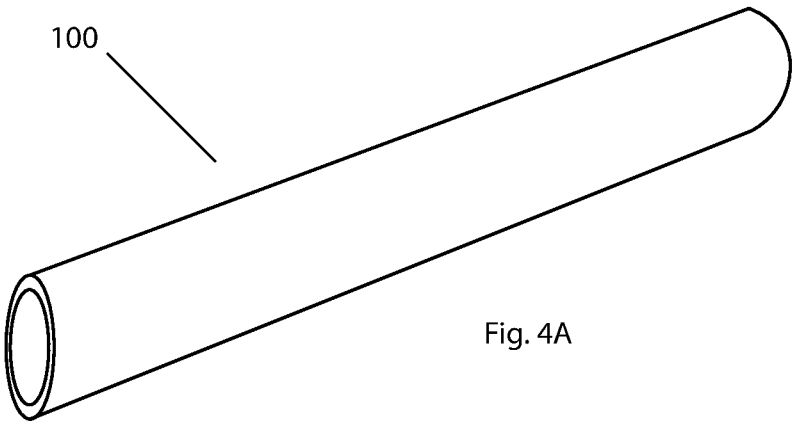

FIG. 4A is first embodiment of the present invention or rifle barrel vibration dampener sleeve 100 composed of a thermoplastic material such as, but not limited to, polyethylene or polypropylene.

Figure 4B:
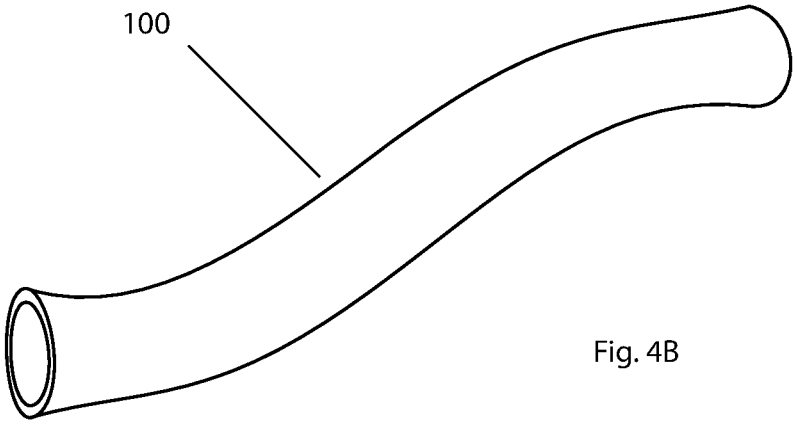

The vibration dampener sleeve 100 shown in FIG. 4B is composed of an elastomeric material such as neoprene, silicone or rubber and is configured to be stretched over the rifle barrel 510.

Figure 5A:
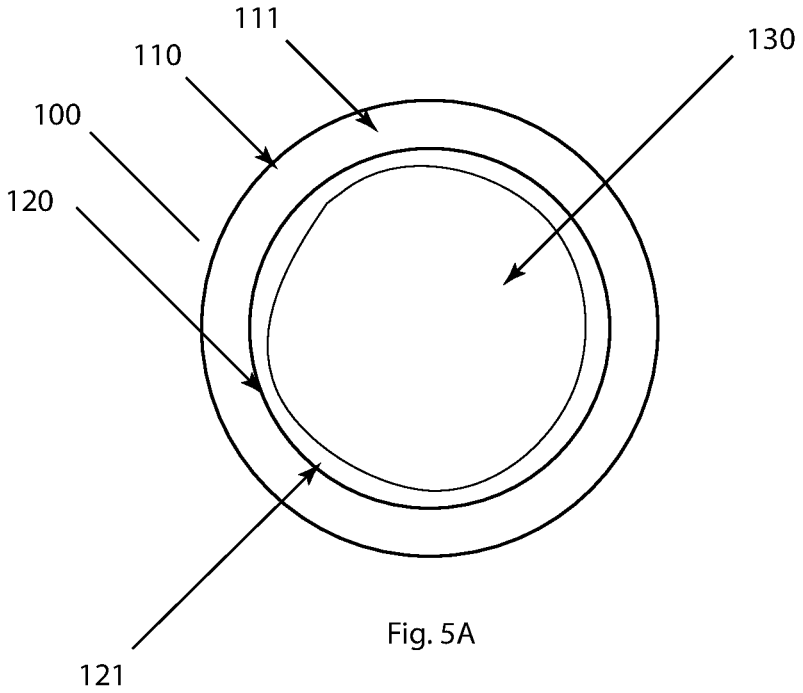
Figure 5B:
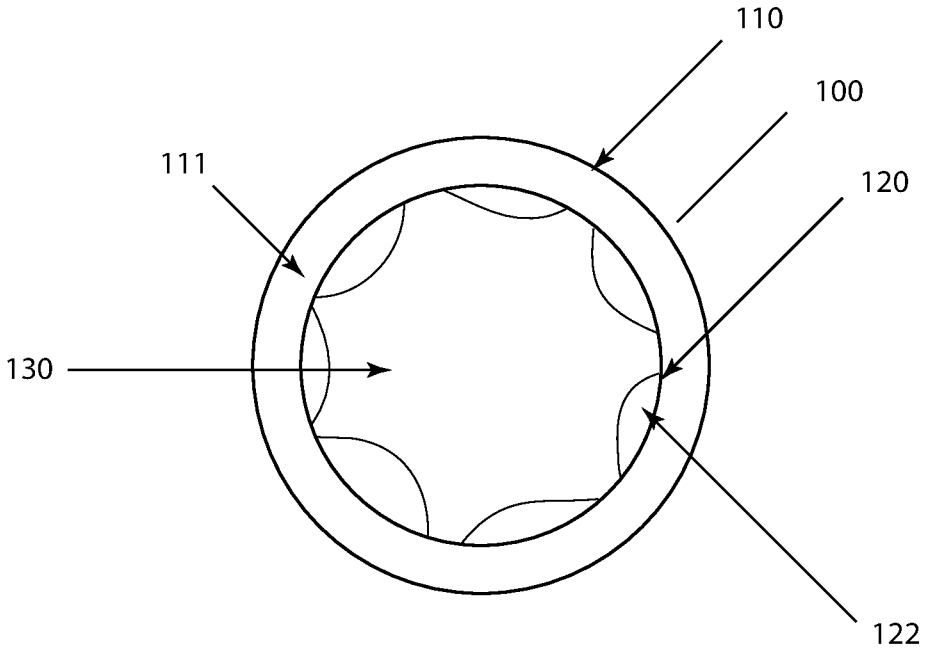

Each of the FIGS. 5A and 5B show a vibration dampener sleeve 100 including an outside diameter 110, inside diameter 120, wall thickness 111, interior void 130 and including an insulating material 121 configured to further reduce the harmonic frequency amplitude of the rifle barrel 510.

FIG. 5A includes insulating material 121 or a substantially uniform elastomeric film configured to uniformly cover the rifle barrel 510 which is under the vibration dampener sleeve 100. The insulating material 121 shown in FIG. 5B is installed on the inside diameter 121 of sleeve 100 in radially uniform ribs or ribbons providing uniform coverage once a thermoplastic sleeve 100 is shrunk to size around a rifle barrel 510.

Figure 6A:
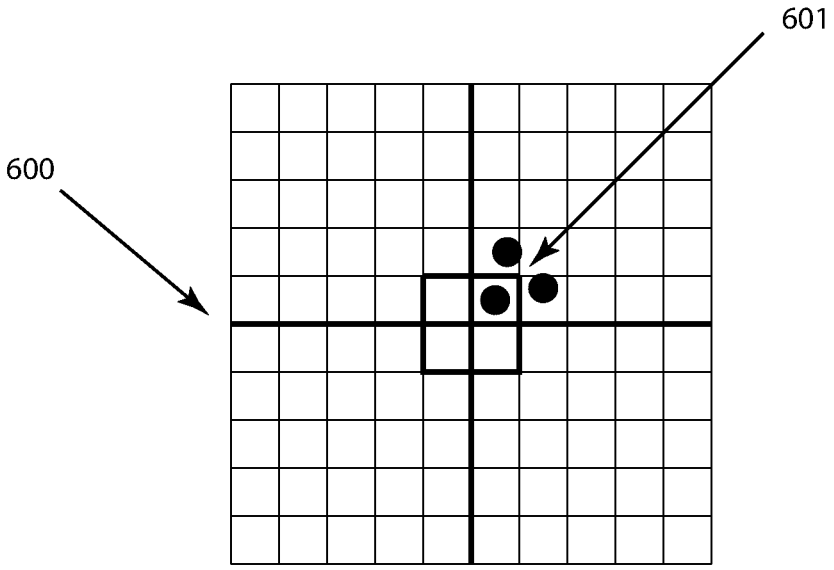
Figure 6B:
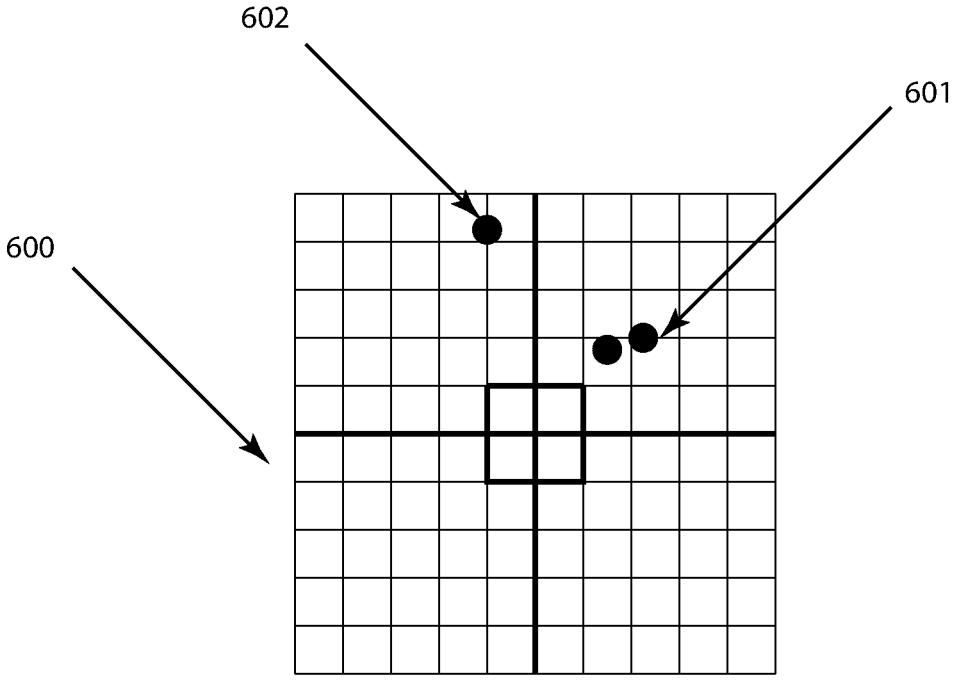

FIGS. 6A and 6B are by way of example and show rifle targets 600 including a shot group 601. Shot 602 shown in FIG. 6B indicates a potential anomalous shot from an inconsistent round fired through a non-harmonically vibration dampened barrel 510.

It is to be understood that the above mentioned arrangements are only illustrative of the application of the principles of the present disclosure. Numerous modifications or alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. A method of installing a vibration dampener sleeve comprising, providing an elastomeric dampener sleeve,
- the sleeve comprising at least one of, neoprene, silicone and rubber, and having,
  - an inside diameter,
  - a length,
  - providing a rifle barrel,
    - the rifle barrel having,
      - an outside diameter,
      - a length,
  - installing the sleeve onto the rifle barrel, and,
  - the sleeve configured to provide a compression fit over the outside diameter of the rifle barrel, wherein the inside diameter of the sleeve is slightly smaller than the outside diameter of the rifle barrel and the sleeve is installed by;
- heating the sleeve,
- placing the sleeve on the rifle barrel, and,
- heating the sleeve to shrink around the outside surface of the rifle barrel.

2. The method of claim 1, wherein the inside diameter of the sleeve is smaller than the outside diameter if the rifle barrel.

3. The method of claim 1, wherein the sleeve comprising one of polypropylene and polyethylene.

4. The method of claim 1, wherein heating the sleeve to shrink around the potion of the outside surface of the rifle barrel comprises causing the sleeve to evenly and securely compress around an entire surface of a portion of the rifle barrel covered by the sleeve.

* * * * *